United States Patent [19]

Bomhard

[11] 4,366,654

[45] Jan. 4, 1983

[54] DOUBLE-WALLED TANK FOR LOW-TEMPERATURE LIQUIDS

[75] Inventor: Helmut Bomhard, Starnberg, Fed. Rep. of Germany

[73] Assignee: Dyckerhoff & Widmann Aktiengesellschaft, Munich, Fed. Rep. of Germany

[21] Appl. No.: 184,486

[22] Filed: Sep. 5, 1980

[30] Foreign Application Priority Data

Sep. 8, 1979 [DE] Fed. Rep. of Germany ..... 2936421

[51] Int. Cl.[3] ..... E04B 1/32

[52] U.S. Cl. ..... 52/224; 52/249; 52/265

[58] Field of Search ..... 52/265, 268, 249, 224

[56] References Cited

U.S. PATENT DOCUMENTS

| | | | |
|---|---|---|---|
| 1,964,870 | 7/1934 | Chappell | 52/249 |
| 2,355,947 | 8/1944 | Bondy | 52/249 |
| 2,382,171 | 8/1945 | Pomykala | 52/224 |
| 3,404,500 | 10/1968 | Akita | 52/249 |
| 3,835,605 | 9/1974 | Ueno | 52/265 |
| 4,069,642 | 1/1978 | Hendriks | 52/224 |

*Primary Examiner*—John E. Murtagh
*Assistant Examiner*—Henry E. Raduazo
*Attorney, Agent, or Firm*—Toren, McGeady & Stanger

[57] ABSTRACT

In a double-walled tank for low-temperature liquids, such as a liquid gas, an inner tank forms a primary safety casing while an outer tank, enclosing the inner tank, forms a secondary safety casing. The inner tank includes a base and an upwardly extending side wall with at least the base being formed of metal. Preferably, the outer tank is formed of reinforced concrete. A thermal insulation layer is located between the two tanks, a ring of reinforced concrete encircles the junction of the side wall and base of the inner tank. The ring is L-shaped and in radial section has an upwardly extending leg in contact with the outside surface of the side wall and a generally horizontal leg in contact with the radially outer part of the lower surface of the base.

5 Claims, 3 Drawing Figures

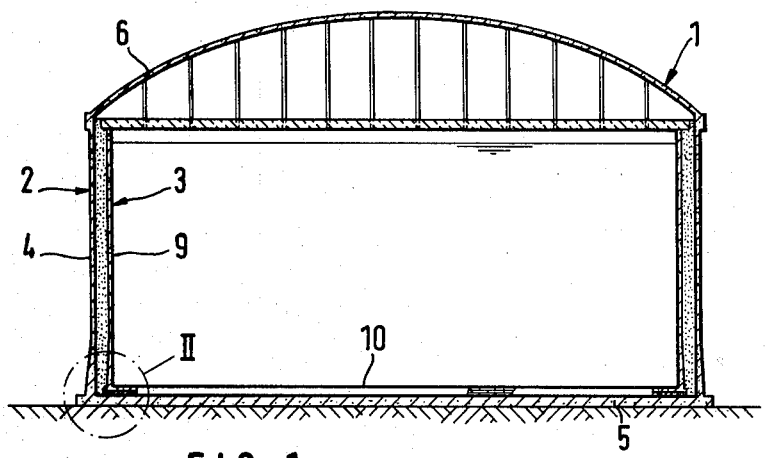
FIG. 1
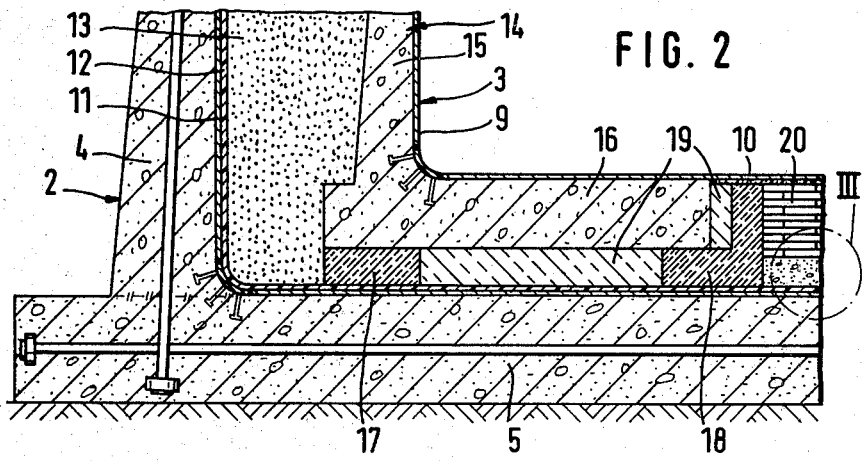
FIG. 2
FIG. 3
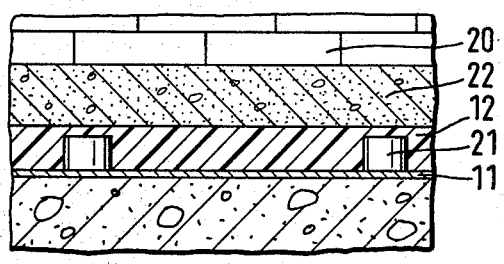

DOUBLE-WALLED TANK FOR LOW-TEMPERATURE LIQUIDS

SUMMARY OF THE INVENTION

The present invention is directed to a double-walled tank for low-temperature liquids, such as a liquid gas, and includes an inner tank, formed of metal at least in the base area, providing a primary safety casing and an outer tank, preferably constructed of reinforced concrete, forming a secondary safety casing, with a thermal insulation layer positioned between the two tanks.

In a tank of this kind, the inner tank acts as the storage container. Accordingly, it forms the primary safety casing while the outer tank provides the secondary safety casing. If any leakage occurs in the inner tank, the low-temperature liquid is prevented from escaping directly into the environment by the outer tank.

This type of structure is covered by safety regulations and the tank has to be designed not only for normal operating stresses, but also for critical conditions. Although the danger of aircraft crashes, which controls the design of nuclear power station safety domes, can be disregarded, the critical stresses include, in particular, explosion shock waves such as result from chemical reactions, and earthquakes, that is dynamic effects. These conditions greatly increase the risk of an explosive brittle fracture of a metal inner tank.

Another factor requiring particular attention in the case of earthquakes, is that a metal inner tank of a given thickness will be lifted from its base on one side and compressed on the opposite side, due to the low weight of its wall, with the result that considerable additional stresses develop and safety is reduced.

In a tank construction of the type mentioned above, it is known to construct the inner tank side wall from reinforced concrete and to provide a steel insert between the prestressed reinforcements used in the wall, note German Offenlegungsschrift No. 21 24 915. To provide for expansion due to temperature variations, the side wall is supported on its foundation by a metal base insert. This arrangement does not afford any appreciable primary safety, because the weaknesses of the entirely metal inner tank are still present in the base area and, in fact, are increased by the very abrupt transition between the reinforced concrete side wall and the metal base.

It is also known to arrange two completely reinforced concrete tanks, one inside the other with a thermal insulation layer located between them as in German Offenlegungschrift No. 27 12 197. The use of a reinforced concrete base for the inner tank is a complex matter, however, if the base is to be able to introduce and maintain any appreciable prestressing force, it must be mounted on the foundation by low-friction layers. Since the material used in such layers experience property changes at very low temperature, it is impossible to guarantee resistance to cracking in a reinforced concrete tank base.

Therefore, the primary object of the present invention is to improve the primary safety of a double tank of the type described above.

In accordance with the present invention, the base area, that is the junction of the base and the side wall, is enclosed by a ring of reinforced concrete having an L-shape in radial cross section. The L-shaped ring has an upwardly extending leg bearing against the lower part of the inner tank side wall and a generally horizontal leg bearing against the radially outer area of the lower surface of the inner tank base. Preferably, the inner tank is rigidly attached to the reinforced concrete ring.

The upwardly extending leg of the ring may extend in the form of a containment for the full height of the inner tank side wall. Preferably, the ring is prestressed so that compressive stress is introduced into the inner tank side wall during use.

The L-shaped ring may directly or indirectly form the inner tank in the side wall area, that is, in the manner of a liner.

The main advantage of the present invention resides in the angular construction of the ring enclosing the inner tank which is in the form of an angular retaining wall and secures the corner or junction area of the tank which is particularly susceptible to damage and, in addition, improves the stress conditions at the junction. Furthermore, in the event of a disturbance, the weight of the imposed load consisting of the liquid within the inner tank located above the horizontal leg of the ring, is activated and counteracts any lifting of the inner tank.

If the upwardly extending leg of the reinforced concrete ring extends for the full height of the inner tank side wall a containment of the inner tank is afforded with a decisive reduction in the risk of brittle failure of the inner tank due to tensile stresses and cooling. By enclosing the inner tank with the prestressed ring it is possible to prestress the inner tank so that a compressive stress reserve is present when the inner tank is in use. In the area of the ring, the inner tank side wall does not have to carry out any load-bearing function, rather it may consist of a non-metallic liner or even a coat of paint on the inside of the ring. Moreover, the liner or coat of paint can be completely dispensed with if the concrete forming the ring is sufficiently liquid-tight and can be maintained in that condition.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing:

FIG. 1 is a vertical schematic section through a double tank embodying the present invention;

FIG. 2 is an enlarged partial cross-sectional view through the base portion of the tank indicated by II in FIG. 1; and FIG. 3 is a further enlarged partial cross-sectional view through the portion of the tank indicated at III in FIG. 2.

DETAIL DESCRIPTION OF THE INVENTION

In the drawing a cylindrical double-walled tank 1 includes an outer tank 2 and an inner tank 3. Outer tank 2 consists of a cylindrical side wall 4, a base 5 and a dome-shaped roof shell 6 all formed of reinforced concrete. Reinforcing members 7 and 8 for prestressing the side wall 4 and the base 5 are shown in FIG. 2. Inner tank 3 is formed of metal and includes a side wall 9 and a base 10.

A metal liner 11 is rigidly connected to the inside surface of the outer tank side wall 4 and provides a vapor-tight layer. An insulating liner 12 is provided on the inner surface of the liner 11 by a thermal insulation layer consisting of polyurethane foam applied in layers and without joints. Alternatively, metal liner 11 may be replaced by some other material preventing the inward passage of vapor, for instance, a synthetic resin paint. The remaining space between the side walls of the outer tank 2 and the inner tank 4 is filled with a thermal insulation material 13, such as perlite.

As shown in detail in FIG. 2, the base area of the inner tank 3, that is, adjacent to the junction between the side wall and the base, is enclosed by a reinforced concrete ring 14. Ring 14 has an upwardly extending leg 15 extending over the full height of the inner tank side wall 9 while a horizontal leg 16 extends inwardly under only the outer area of the inner tank base 10. The combination of the upwardly extending leg 15 and the horizontal leg 16 form an L-shaped ring providing a containment for the inner tank wall 9 with the L-shaped ring being in the form of an angularly shaped retaining wall extending inwardly under the radially outer portion of the inner tank base 10. At its radially inner and outer ends, the horizontal leg 16 rests on parts 17, 18 of a pressure-tight insulation. The spaces between the parts 17 and 18 and between the part 18 and the radially inner surface of the horizontal leg 16 are filled with a conventional thermal insulation 19.

In a conventional manner, radially inwardly of the thermal insulation part 18, the inner tank base bears on a thermal insulation layer 20 consisting of foam glass. Below the layer 20, reinforcing members in the form of load-bearing spacers 21 are foamed into a polyurethane foam liner 12, note FIG. 3. The spacers 21 are arranged in a regular pattern and bear directly on the metal liner 11. A load-distributing reinforced concrete slab 22 is located above the spaces 21 and includes reinforcing members which are ductile at low temperatures. The pressure-tight thermal insulation layer 20 and in turn the base 10 of the inner tank 3 bear on the slab 22. The dimensions of the prestressing members used in the upwardly extending leg 15 of the ring 14 enclosing the inner tank side wall 9 depend on the construction of the inner tank 3. When the inner tank is dimensioned according to the hydrostatic pressure of the liquid to be filled into it, the ring 14 increases the primary safety desirable for security reasons and, more particularly, the security against brittle fracture of the inner tank side wall. The prestressing members may be dimensioned so that the inner tank side wall experiences compressive prestressing. Furthermore, the portion of the ring contacting the side wall of the tank may partially or completely take over the function of the inner tank so that only the base 10 in the central region of the inner tank is formed of metal.

While specific embodiments of the invention have been shown and described in detail to illustrate the application of the inventive principles, it will be understood that the invention may be embodied otherwise without departing from such principles.

What is claimed is:

1. A double-walled tank for low-temperature liquids, such as a liquid gas, comprising an upwardly extending inner tank forming a primary safety casing, said inner tank having a generally horizontally arranged base and an upwardly extending side wall and at least said base being formed of metal, an upwardly extending outer tank enclosing and spaced outwardly from said inner tank and forming a secondary safety casing, a thermal insulation layer located between said inner tank and said outer tank, wherein the improvement comprises a ring of prestressed concrete at least laterally enclosing the junction of said side wall and the base of said inner tank so that compressive stress is provided in said side wall of said inner tank when it is in use, said ring being L-shaped in radial section and having an upwardly extending leg and a generally horizontally extending leg with said upwardly extending leg at the lower end thereof bearing against the outside surface of said metal base at least at the bottom portion of said side wall extending upwardly from the junction with said base, said generally horizontally extending leg is annular and is located below and in contact with the lower surface of said base extending radially inwardly from the junction with said side wall with the radially inner edge of said generally horizontally extending leg spaced a significant distance outwardly from the upwardly extending axis of said inner tank, and a thermal insulation material located below and extending downwardly from said base of said inner tank radially inwardly of the radially inner surface of said generally horizontally extending leg of said ring.

2. A double-walled tank, as set forth in claim 1, wherein said outer tank is formed of reinforced concrete.

3. A double-walled tank, as set forth in claim 2, wherein said inner tank being rigidly attached to said L-shaped ring.

4. A double-walled tank, as set forth in claim 1, wherein said upwardly extending leg of said ring extends for the full height of said side wall of said inner tank forming a containment therefor.

5. A double-walled tank, as set forth in claim 1, wherein said upwardly extending leg of said ring forms said side wall of said inner tank in the manner of a liner.

* * * * *